US012135142B2

(12) United States Patent
Lee et al.

(10) Patent No.: US 12,135,142 B2
(45) Date of Patent: Nov. 5, 2024

(54) SYSTEM FOR VENTILATION, DEHUMIDIFICATION, AND COOLING

(71) Applicant: KYUNGDONG NAVIEN CO., LTD., Pyeongtaek-si (KR)

(72) Inventors: Myoung Seop Lee, Seoul (KR); Kyung Chang Jang, Seoul (KR); Seon Won Kim, Seoul (KR); Ho Min Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 21 days.

(21) Appl. No.: 17/546,220

(22) Filed: Dec. 9, 2021

(65) Prior Publication Data

US 2022/0186945 A1 Jun. 16, 2022

(30) Foreign Application Priority Data

Dec. 11, 2020 (KR) ..... 10-2020-0173017
Nov. 29, 2021 (KR) ..... 10-2021-0166925

(51) Int. Cl.
*F24F 3/14* (2006.01)
*F24F 11/74* (2018.01)

(52) U.S. Cl.
CPC ..... *F24F 3/14* (2013.01); *F24F 11/74* (2018.01); *F24F 2003/1464* (2013.01); *F24F 2203/1032* (2013.01)

(58) Field of Classification Search
CPC .... F24F 3/14; F24F 3/1423; F24F 2003/1464; F24F 2203/1032; F24F 1/0035; F24F 1/0041; F24F 2003/003; F24F 2003/1458; F24F 3/147
See application file for complete search history.

(56) References Cited

U.S. PATENT DOCUMENTS 10,823,437 B2 * 11/2020 Lee ..... F24F 3/1423
10,948,202 B2 * 3/2021 Lee ..... F24F 3/153
2015/0354839 A1 * 12/2015 Lee ..... F24F 5/001 62/271
2016/0146513 A1 * 5/2016 Lee ..... F24F 3/1423 62/271

(Continued)

FOREIGN PATENT DOCUMENTS

JP 2004226017 A * 8/2004 ..... F24F 3/1423
JP 2012127649 A 7/2012

(Continued)

OTHER PUBLICATIONS

KR 101794730 B1 English Machine Translation (Year: 2017).*

(Continued)

*Primary Examiner* — Jenna M Maroney
(74) *Attorney, Agent, or Firm* — Dority & Manning, P.A.

(57) ABSTRACT

A system for ventilation, dehumidification, and cooling includes an outdoor unit dehumidifying and cooling introduced outside air; and an indoor unit connected to the outdoor unit to perform ventilation, in which the outdoor unit includes a dehumidification rotor, an evaporative cooler, an evaporative condenser, a ventilation damper, a heating unit, and a controller operating and stopping at least one of the dehumidification rotor, the evaporative cooler, the evaporative condenser, the ventilation damper, or the heating unit.

18 Claims, 9 Drawing Sheets

(56) References Cited

U.S. PATENT DOCUMENTS

| | | | | |
|---|---|---|---|---|
| 2018/0320911 | A1* | 11/2018 | Lee | F24F 5/0014 |
| 2018/0328603 | A1* | 11/2018 | Lee | F24F 11/67 |
| 2019/0063761 | A1* | 2/2019 | Jin | F24F 11/30 |
| 2019/0063777 | A1* | 2/2019 | Jin | F24F 7/08 |
| 2022/0186945 | A1* | 6/2022 | Lee | F24F 5/0035 |
| 2023/0204265 | A1* | 6/2023 | Lee | F25B 39/04 62/304 |

FOREIGN PATENT DOCUMENTS

| | | | | | |
|---|---|---|---|---|---|
| KR | 928843 | B1 | * | 11/2009 | F24F 3/14 |
| KR | 20140067558 | A | * | 6/2014 | F24F 11/64 |
| KR | 20170114487 | A | | 10/2017 | |
| KR | 101794730 | B1 | * | 11/2017 | |
| KR | 20190024394 | A | | 3/2019 | |
| KR | 20160037387 | A | * | 6/2021 | F24F 3/14 |
| KR | 20220083368 | A | * | 6/2022 | F24F 1/18 |
| KR | 20220083585 | A | * | 6/2022 | F24F 1/0035 |
| WO | WO-2012148110 | A2 | * | 11/2012 | B01D 53/06 |
| WO | WO-2017086680 | A1 | * | 5/2017 | F24F 3/1423 |

OTHER PUBLICATIONS

Korean Notice of Allowance (w/ English Machine Translation) for corresponding Application No. 10-2021-0166925, dated May 31, 2024, 6 pages.

* cited by examiner

SYSTEM FOR VENTILATION, DEHUMIDIFICATION, AND COOLING

CROSS-REFERENCE TO RELATED APPLICATION (S)

This application claims benefit of priority to Korean Patent Application No. 10-2020-0173017 filed on Dec. 11, 2020 and No. 10-2021-0166925 filed on Nov. 29, 2021 in the Korean Intellectual Property Office, the disclosure of which is incorporated herein by reference in its entirety.

BACKGROUND

1. Field

The present disclosure relates to a system for ventilation, dehumidification, and cooling for performing air cleaning, ventilation, dehumidification, and cooling functions simultaneously.

2. Description of Related Art

An air conditioner is a device controlling an indoor temperature and indoor humidity, ventilating an indoor space, or purifying indoor air according to a request of a user to keep the indoor space comfortable.

However, there is no single device that may actually control an indoor temperature and indoor humidity, ventilate an indoor space, and purify indoor air. In a case in which a plurality of devices that may perform the above-described functions are provided, a large machine room is required to accommodate all thereof, and a large amount of power is consumed in order to perform all of the above-described functions. As a result, space efficiency and energy efficiency deteriorate.

Accordingly, a need for a system for ventilation, dehumidification, and cooling that performs air cleaning, ventilation, dehumidification, and cooling functions simultaneously, has improved driving efficiency for each function, and consumes less power to improve energy efficiency has emerged.

SUMMARY

An aspect of the present disclosure may provide a system for ventilation, dehumidification, and cooling that is capable of efficiently performing air cleaning, ventilation, dehumidification, and cooling simultaneously, and securing high power efficiency while performing cooling and dehumidification using an evaporative cooler and an evaporative condenser.

According to an aspect of the present disclosure, a system for ventilation, dehumidification, and cooling may include: an outdoor unit dehumidifying and cooling introduced outside air; and an indoor unit connected to the outdoor unit to perform ventilation, in which the outdoor unit may include: a first flow path connecting the outside and an indoor space and on which an evaporative cooler is disposed; a second flow path connecting the outside or the indoor space and a dehumidification rotor and on which a heating unit is disposed; a third flow path connecting the evaporative cooler and the outside; a fourth flow path connecting an evaporative condenser and the outside; the dehumidification rotor rotating in a first region provided on the first flow path and a second region provided on the second flow path, dehumidifying the first region, and regenerated in the second region; the evaporative cooler including a dry channel provided on the first flow path and a wet channel provided on the third flow path and to which water is sprayed by a first water injection module, and cooling air passing through the dehumidification rotor; the evaporative condenser through which the air passing through the dry channel of the evaporative cooler passes on the fourth flow path and into which the water is sprayed by a second water injection module; a ventilation damper provided on the first flow path and controlling introduction of the air passing through the evaporative cooler into the indoor space; the heating unit provided on the second flow path on the upstream side of the second region and heating the air moving to the second region; and a controller operating or stopping at least one of the dehumidification rotor, the evaporative cooler, the evaporative condenser, the ventilation damper, or the heating unit.

The third flow path may be branched from the first flow path and connected to the outside through the evaporative cooler, or may be formed as a flow path separate from the first flow path and connect the evaporative cooler and the outside, and the fourth flow path may be branched from the first flow path and connected to the outside through the evaporative condenser, or may be formed as a flow path separate from the first flow path and connect the evaporative condenser and the outside.

Alternatively, one ends of the third flow path and the fourth flow path may be connected to each other and connected to the outside so that the air flowing on the third flow path and the air flowing on the fourth flow path may join and be discharged together to the outside. That is, the air discharged from the evaporative cooler and the air discharged from the evaporative condenser may be discharged through the third flow path and the fourth flow path, respectively, and then join to be collectively discharged when being discharged to the outside.

The evaporative condenser may be connected to an evaporator in the indoor unit through a compressor or a pressure sensor.

The system for ventilation, dehumidification, and cooling may further include: an OA ventilation damper controlling introduction of the outside air into the second flow path; and an RA ventilation damper 124 controlling discharging of the indoor air to the outside.

The system for ventilation, dehumidification, and cooling may further include: a bleed fan provided on the third flow path and discharging the air passing through the wet channel to the outside; a condensing fan discharging the air passing through the evaporative condenser to the outside; a dehumidification fan provided on the first flow path and making the air passing through the first region of the dehumidification rotor flow to the indoor space; and a regeneration fan provided on the second flow path and discharging the air passing through the second region to the outside.

The system for ventilation, dehumidification, and cooling may further activate at least one of a cooling mode, a ventilation-dehumidification mode, a dehumidification-ventilation mode, a dehumidification mode, an air-cleaning-ventilation mode, or an air-cleaning mode, in addition to a ventilation-dehumidification-cooling mode.

In the ventilation-dehumidification-cooling mode, the controller may operate the dehumidification rotor, the dehumidification fan, the evaporative cooler, and the evaporative condenser, open the ventilation damper, operate the heating unit and the regeneration fan, and open the OA ventilation damper and the RA ventilation damper to supply low-temperature dehumidified air into the indoor space through the first flow path, and may operate the bleed fan and the condensing fan to discharge the air discharged from the wet channel of the evaporative cooler and the evaporative condenser to the outside through the third flow path and the fourth flow path.

When the cooling mode is activated, the controller may close the ventilation damper to block the introduction of air into the indoor space, operate the dehumidification rotor, the dehumidification fan, the evaporative cooler, and the evaporative condenser, open the OA ventilation damper and close the RA ventilation damper to supply only the outside air to the second flow path, operate the heating unit and the regeneration fan, and continuously operate the bleed fan and the condensing fan to discharge the air discharged from the wet channel of the evaporative cooler and the evaporative condenser to the outside through the third flow path and the fourth flow path.

When the ventilation-dehumidification mode is activated, the controller may open the ventilation damper to supply the air to the indoor space, operate the dehumidification rotor, the dehumidification fan, and the evaporative cooler, stop the evaporative condenser, close the OA ventilation damper and open the RA ventilation damper to supply only the air returning from the indoor space to the second flow path, and operate the heating unit and the regeneration fan.

When the dehumidification-ventilation mode is activated, the controller may additionally open the OA ventilation damper and control other components in the same manner as in the ventilation-dehumidification mode.

In the ventilation-dehumidification mode and the dehumidification-ventilation mode, weak cooling may be incidentally undertaken by the evaporative cooler that is being operated.

When the air-cleaning-ventilation mode is activated, the controller may operate the dehumidification rotor and the dehumidification fan, stop the evaporative cooler and the evaporative condenser, open the ventilation damper to supply the air to the indoor space, close the OA ventilation damper and open the RA ventilation damper to supply only the air returning from the indoor space to the second flow path, operate the regeneration fan, and stop the heating unit.

When the air-cleaning mode is activated, the controller may stop the outdoor unit, and operate the indoor unit to supply the air to the indoor space through an internal filter of the indoor unit.

When the dehumidification mode is activated, the controller may close the ventilation damper to block the introduction of air into the indoor space, operate the dehumidification rotor, the dehumidification fan, the evaporative cooler, and the evaporative condenser, open the OA ventilation damper and close the RA ventilation damper to supply only the outside air to the second flow path, operate the heating unit and the regeneration fan, operate the bleed fan and the condensing fan to discharge the air discharged from the wet channel of the evaporative cooler and the evaporative condenser to the outside, and operate the indoor unit together to perform additional dehumidification.

Alternatively, even when a mode other than the dehumidification mode is activated, the indoor unit may be operated together to perform additional dehumidification in a case in which dehumidification is not sufficiently undertaken. The evaporative condenser may be additionally operated for the operation of the indoor unit regardless of the mode. That is, in a case in which dehumidification is not sufficiently undertaken, the system for ventilation, dehumidification, and cooling system is driven as in the cooling mode, and once dehumidification is sufficiently undertaken, the cooling mode is deactivated.

The indoor unit operated in the above-described modes may be an air conditioner, and the controller may operate the outdoor unit and control the air conditioner to perform cooling simultaneously. Specifically, the indoor unit may be a ceiling type air conditioner installed on a ceiling, and the first flow path of the outdoor unit may be connected to the indoor unit so that air supplied from the outdoor unit is supplied to the indoor space through the indoor unit.

The system for ventilation, dehumidification, and cooling may further include an RA ventilation damper controlling discharging of the indoor air to the outside, in which the RA ventilation damper is connected to the wet channel of the evaporative cooler.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a valve, a damper, or a pump may be installed in an arbitrary portion of a flow path on which air or water flows, and may be installed in a position on the flow path that may be easily derived by those skilled in the art as necessary even in a case in which the position is omitted in exemplary embodiments in the present disclosure.

Figure 1:
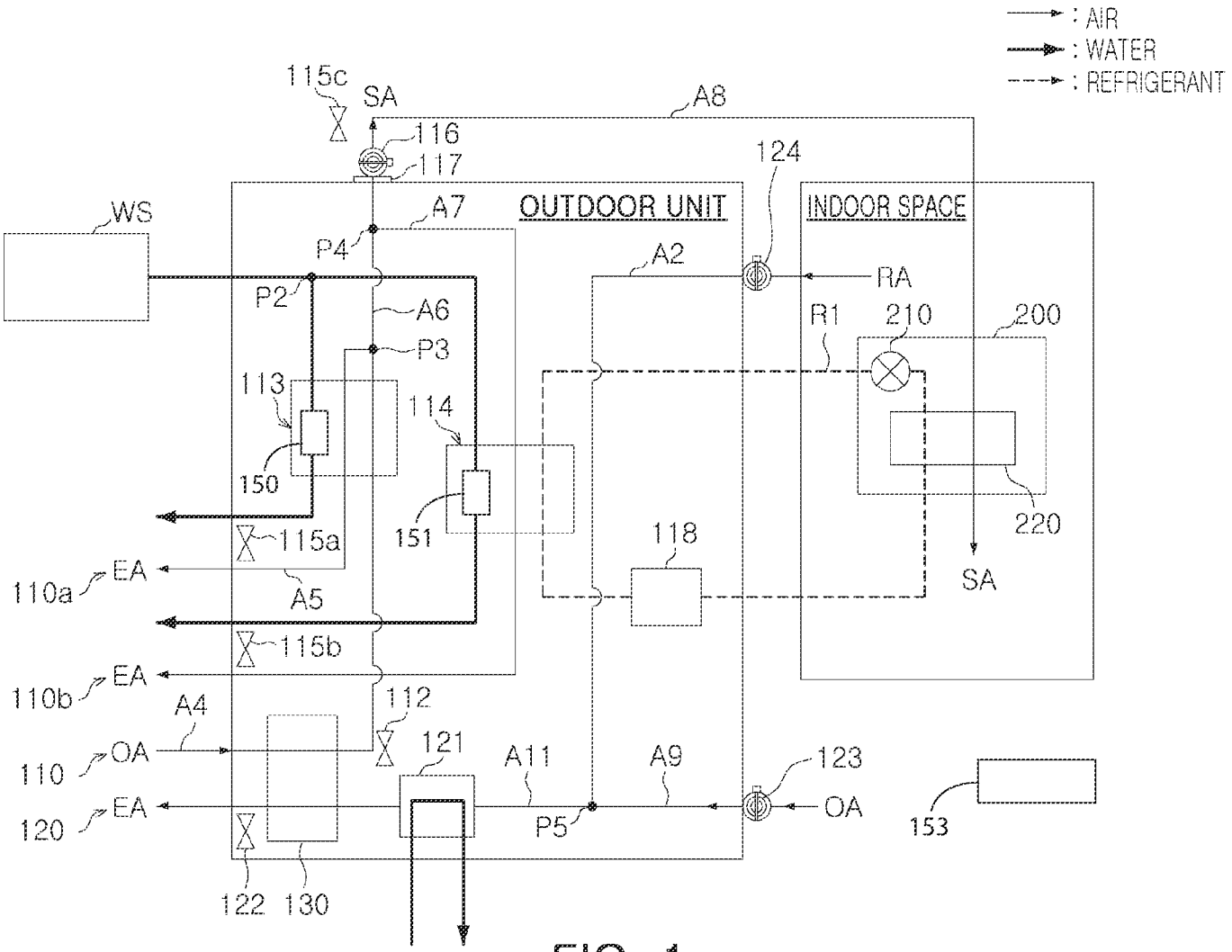
FIG. 1 schematically illustrates an air flow along a flow path in a system for ventilation, dehumidification, and cooling according to an exemplary embodiment in the present disclosure when a ventilation-dehumidification-cooling mode is activated.

FIG. 1 is a diagram illustrating an overall configuration of a system for ventilation, dehumidification, and cooling according to an exemplary embodiment in the present disclosure, and schematically illustrates flows of air, water, and a refrigerant along flow paths in the system for ventilation, dehumidification, and cooling when a ventilation-dehumidification-cooling mode is activated. In FIG. 1, a thin solid line arrow indicates a flow direction of the air flowing along the flow path, a thick solid line arrow indicates a flow direction of the water flowing through a water supply source or a heating unit, and a dotted line arrow indicates a flow direction of the refrigerant flowing through a refrigerant pipe.

Meanwhile, an evaporative condenser 114 may be connected to an evaporator in an indoor unit 200 through a compressor or a pressure sensor. In FIG. 1, the system includes a refrigerant cycle R1 including the evaporative condenser 114 condensing the compressed refrigerant, an expansion valve 210 through which the refrigerant passing through the evaporative condenser 114 is expanded, an evaporator 220 evaporating the refrigerant passing through the expansion valve 210, and a compressor 118 compressing the refrigerant passing through the evaporator 220.

Here, the expansion valve 210 and the evaporator 220 through which the refrigerant cycle R1 passes may be disposed in the indoor unit 200, and the evaporator 114 and the compressor 118 may be disposed in an outdoor unit 100. However, the components of the indoor unit 200 may be disposed in the outdoor unit 100, or the components of the outdoor unit 100 may be disposed in the indoor unit 200 to execute the same function.

That is, according to an exemplary embodiment in the present disclosure illustrated in FIG. 1, the outdoor unit 100 may be connected to the indoor unit 200 by the refrigerant pipe through the evaporative condenser 114 and the compressor 118, which is only an example, and the scope of the claims is not limited thereto.

As illustrated in FIG. 1, the system for ventilation, dehumidification, and cooling according to an exemplary embodiment in the present disclosure may activate the ventilation-dehumidification-cooling mode, may make outside air (OA) introduced from the outside through a first flow path 110 pass through a dehumidification rotor 130 to dehumidify the air, and supply the air whose temperature is raised by the dehumidification to an evaporative cooler 113 using a dehumidification fan 112.

Here, the dehumidified air supplied through a dry channel of the evaporative cooler 113 may be cooled by exchanging heat with air passing through a wet channel of the evaporative cooler 113 and discharged. As a result, the dehumidified air may have a lower temperature than that when being introduced into the evaporative cooler 113.

Further, a portion of the air passing through the evaporative cooler 113 and cooled by the heat exchange may be supplied (SA) to an indoor space through a ventilation damper 116 installed together with a filter 117 along the first flow path 110, another portion of the air may be supplied to the wet channel of the evaporative cooler 113 again along a third flow path 110*a*, and the remaining portion of the air may be supplied to the evaporative condenser 114 along a fourth flow path 110*b*. In the present exemplary embodiment, the number of branch points (P3 and P4) is two, and branching into three may be made at one branch point.

In a specific example, in a case in which a temperature of the outside air (OA) introduced from the outside is 35° C., a temperature of the air passing through the dehumidification rotor 130 is raised to about 40° C. to 45° C., a temperature of the air passing through and discharged from the dry channel of the evaporative cooler is lowered to 23° C. to 24° C., and finally, the low-temperature dehumidified air is supplied to the indoor space through the ventilation damper 116 and the filter 117.

Here, another portion of the air passing through the evaporative cooler 113 may be introduced into the evaporative cooler 113 again through the wet channel of the evaporative cooler 113, may exchange heat to cool the air passing through the dry channel of the evaporative cooler 113 (for example, the air of a low temperature of 23° C. to 24° C. exchanges heat so that the temperature is raised to 36° C.) and becomes high-temperature air, and may be discharged (EA) to the outside through a bleed EA damper installed on the third flow path 110*a*.

At the time of the heat exchange, an additional process in which a first water injection module 150 and a second water injection module 151 in the evaporative cooler 113 and the evaporative condenser 114 spray water supplied from a water supply source WS to the evaporative cooler 113 and the evaporative condenser 114 may be performed to assist in cooling the air, thereby improving cooling efficiency and energy efficiency.

That is, the evaporative cooler 113 and the evaporative condenser 114 may perform cooling using the low-temperature dehumidified air, and then discharge the high-temperature air, thereby improving the cooling efficiency and reducing power consumption to improve energy efficiency.

Meanwhile, the remaining portion of the air cooled by the heat exchange when passing through the evaporative cooler 113 may be introduced into the evaporative condenser 114 along the fourth flow path 110*b*. As described above, the second water injection module 151 may spray the water supplied from the water supply source WS to the low-temperature dehumidified air, such that efficiency in heat exchange by evaporative latent heat is improved. As a result, when the evaporative condenser 114 condenses the high-temperature and high-pressure refrigerant and raises an internal condensing temperature, the internal condensing temperature may be prevented from being excessively raised. That is, efficiency in evaporative latent heat exchange may be significantly improved to prevent the internal condensing temperature from being excessively raised, thereby preventing excessive power consumption and improving energy efficiency.

As a specific example, air of 23° C. to 24° C. may be introduced into the evaporative condenser 114, latent heat exchange may be made by spraying water of about 21° C. to exchange heat with the high-temperature and high-pressure refrigerant present inside, and the air of 23° C. to 24° C. used in the heat exchange may become high-temperature air of 36° C. and be discharged (EA) to the outside through the bleed EA damper on the fourth flow path 110*b*.

The air may be discharged (EA) to the outside by controlling opening and closing of the bleed EA damper installed on the fourth flow path 110*b*, and a condensing fan 115*b* may be operated so that the air flows to the outside along the fourth flow path 110*b*.

Meanwhile, each water injection module 150, 151 may be connected to the water supply source WS, may be disposed on a water supply flow path passing through the evaporative cooler 113 and the evaporative condenser 114, and sprays the water supplied from the water supply source WS at the evaporative cooler 113 and the evaporative condenser 114.

Here, the water supply source WS supplying water to each water injection module 150, 151 may mean direct water.

The air may be supplied (SA) to and circulated in the indoor space to provide fresh air, and then return (RA) from the indoor space. The air (RA) returning from the indoor space and the introduced outside air (OA) may be collected, regenerated, and discharged to the outside through a second flow path 120. The air (RA) returning from the indoor space and the introduced outside air (OA) may be supplied to a heating unit 121 along the second flow path, may be heated by heat of hot water in the heating unit 121, and may be supplied to the dehumidification rotor 130 to evaporate moisture contained in a second region 132 of the dehumidification rotor 130, thereby increasing a drying rate of the dehumidification rotor 130. Then, the air subjected to the heat exchange may be discharged (EA) to the outside through a regeneration fan 122.

As a specific example, low-temperature dehumidified air of 23° C. to 24° C. may be supplied (SA) to and circulated in the indoor space, the air may return (RA) from the indoor space when the temperature of the air reaches about 27° C. corresponding to a temperature of the indoor space, and the returning air may flow to the second flow path 120 together with outside air (OA) introduced from the outside of about 35° C. Here, the air passing through the heating unit 121 and the second region 132 of the dehumidification rotor 130 may be heated to about 45° C. by the heating unit 121 to which hot water of about 70° C. is supplied, and the high-temperature air of about 45° C. may be discharged (EA) to the outside through a regeneration EA damper. The air may be discharged (EA) to the outside by controlling opening and closing of the regeneration EA damper, and the regeneration fan 122 may be operated so that the air flows to the outside along the second flow path 120.

Further, when the air (RA) returning from the indoor space and the introduced outside air (OA) are collected, regenerated, and discharged to the outside, only the air returning from the indoor space may be regenerated and then discharged to the outside, or only the introduced outside air may be regenerated and then discharged to the outside. Accordingly, in order to selectively determine introduction of air, an OA ventilation damper 123 may be connected to the second flow path directed to the dehumidification rotor 130 from the outside or an RA ventilation damper 124 may be connected to the second flow path directed to the dehumidification rotor 130 from the indoor space. Air to be introduced into the second flow path may be determined by opening and closing the ventilation dampers 123 and 124.

Further, the heating unit 121 may mean hot water that is supplied or hot water that is generated by solar heat. However, another heat source may be provided and used for direct water without using hot water, and the exemplary embodiments in the present disclosure are not limited thereto.

According to the above-described exemplary embodiment, the air (RA) returning from the indoor space and the introduced outside air (OA) may be collected, regenerated, and then discharged to the outside along the second flow path 120. On the other hand, according to another exemplary embodiment in the present disclosure, the air (RA) returning from the indoor space may pass through the wet channel of the evaporative cooler 113 and be discharged along the third flow path 110*a* rather than the second flow path 120.

That is, according to another exemplary embodiment in the present disclosure, the air (OA) introduced into the indoor space from the outside may be introduced into the wet channel of the evaporative cooler 113 and discharged (EA) to the outside through the bleed EA damper installed on the third flow path 110*a*, and the air (RA) returning from the indoor space may pass through the wet channel of the evaporative cooler 113 and be discharged (EA) to the outside through the bleed EA damper.

Accordingly, the system for ventilation, dehumidification, and cooling according to an exemplary embodiment in the present disclosure may make low-temperature dehumidified air be introduced into the indoor space by flowing of the air as described above to ventilate the indoor space and dehumidify, cool, and clean the indoor air, and may control the flow of the air to significantly improve the cooling efficiency and the energy efficiency.

The system for ventilation, dehumidification, and cooling according to an exemplary embodiment in the present disclosure may include the outdoor unit 100 dehumidifying and cooling the introduced outside air (OA), and the indoor unit 200 connected to the outdoor unit 100 to perform ventilation, in which the outdoor unit 100 may include: the first flow path 110 connecting the outside and an indoor space and on which the evaporative cooler 113 is disposed; the second flow path 120 connecting the outside or the indoor space to the dehumidification rotor 130 and on which the heating unit 121 is disposed; the third flow path 110*a* connecting the evaporative cooler 113 and the outside; the fourth flow path 110*b* connecting the evaporative condenser 114 and the outside; the dehumidification rotor 130 rotating in a first region 131 provided on the first flow path 110 and the second region 132 provided on the second flow path 120, dehumidifying the first 5 region, and regenerated in the second region 132; the evaporative cooler 113 including the dry channel provided on the first flow path 110 and the wet channel provided on the third flow path 110*a* and to which water is sprayed by the first water injection module 150, and cooling the air passing through the 10 dehumidification rotor 130; the evaporative condenser 114 through which at least a portion of the air passing through the dry channel of the evaporative cooler passes on the fourth flow path 110*b* and into which the water is sprayed by the second water injection module 151; the ventilation damper 116 provided on the first flow path 110 and controlling introduction of the air passing through the evaporative cooler 113 into the indoor space; the heating unit 121 provided on the second flow path 120 on the upstream side of the second region 132 and heating the air moving to the second region 132; and a controller 153 operating or stopping at least one of the dehumidification rotor 130, the evaporative cooler 113, the evaporative condenser 114, the ventilation damper 116, or the heating unit 121.

According to an exemplary embodiment, the third flow path 110*a* may be branched from the first flow path 110, and may be branched at the branch point P3 and connected to the outside through the evaporative cooler 113 as illustrated in FIG. 1. As a result, the air passing through the dry channel of the evaporative cooler 113 may pass through the wet channel of the evaporative cooler 113 and be discharged (EA) to the outside.

According to another exemplary embodiment, the third flow path 110*a* may be formed separately from the first flow path 110, and air may be introduced (OA) into the third flow path 110*a* from the outside and discharged (EA) to the outside through the evaporative cooler 113, which will be described later with reference to FIG. 7.

Further, the fourth flow path 110*b* may be branched from the first flow path 110, and may be branched at the branch point P4 and connected to the outside through the evaporative condenser 114 to discharge (EA) the air to the outside as illustrated in FIG. 1.

According to another exemplary embodiment, the fourth flow path 110*b* may be formed separately from the first flow path 110 and may connect the evaporative condenser 114 to the outside. The fourth flow path 110*b* may receive air from the dry channel of the evaporative cooler 113. Alternatively, the fourth flow path 110*b* may be connected to the outside, and air may be introduced (OA) into the fourth flow path 110*b* from the outside and discharged (EA) to the outside through the evaporative condenser 114, which will be described later with reference to FIG. 7.

Hereinafter, the exemplary embodiment in which the third flow path 110*a* and the fourth flow path 110*b* are branched from the first flow path 110 will be mainly described.

The first flow path 110 may include a supply flow path A4 through which the air is supplied from the outside to the indoor space to supply the air to the evaporative cooler 113, and an indoor supply flow path A8 passing through the evaporative cooler 113 and connected to the indoor space at the branch points P3 and P4. The third flow path 110*a* may include a cooler supply flow path A5 connected to the wet channel of the evaporative cooler 113 at the branch point P3, and the fourth flow path 110*b* may include a condenser supply flow path A7 connected to the evaporative condenser 114 at the branch point P4. In the present exemplary embodiment, the number of branch points (P3 and P4) is two, and branching into three may be made at one branch point. The indoor supply flow path A8 may be connected to the indoor unit 200, and the air may be cooled by passing through the evaporator 220 and supplied to the indoor space on the indoor supply flow path A8.

Further, the system for ventilation, dehumidification, and cooling according to an exemplary embodiment in the present disclosure may include a discharge flow path A2 by which the indoor air is discharged to the outside. The discharge flow path A2 may join regeneration flow paths A9 and A11 at a joining point P5 of the regeneration flow paths A9 and A11. The indoor air may regenerate the dehumidification rotor 130 and then be discharged to the outside through the discharge flow path A2 joining the regeneration flow paths A9 and A11. Therefore, the second flow path 120 may include the discharge flow path A2 and the regeneration flow paths A9 and A11.

However, according to another exemplary embodiment in the present disclosure, the indoor air may be discharged to the outside through the discharge flow path A2 joining the cooler supply flow path A5.

The system for ventilation, dehumidification, and cooling according to an exemplary embodiment in the present disclosure may further include: a bleed fan 115*a* provided on the third flow path 110*a* and discharging (EA) the air passing through the wet channel of the evaporative cooler 113 to the outside; the condensing fan 115*b* discharging (EA) the air passing through the evaporative condenser 114; the dehumidification fan 112 provided on the first flow path 110 and making the air passing through the first region 131 of the dehumidification rotor 130 flow (SA) to the indoor space; and the regeneration fan 122 provided on the second flow path 120 and discharging (EA) the air passing through the second region 132 of the dehumidification rotor 130 to the outside.

Here, a flow path through which the air passing through the wet channel of the evaporative cooler 113 is discharged to the outside and a flow path through which the air passing through the evaporative condenser 114 is discharged to the outside may be the same as or different from each other. Even in a case in which the flow path through which the air passing through the wet channel of the evaporative cooler 113 is discharged to the outside and the flow path through which the air passing through the evaporative condenser 114 is discharged to the outside are different from each other, the flow paths may join into one flow path later, and the air may be discharged to the outside through the one flow path.

That is, according to an exemplary embodiment in the present invention, the third flow path 110*a* and the fourth flow path 110*b* may join each other, and the air may be discharged to the outside through the joining flow path.

Further, a ventilation fan 115*c* may be further installed on one side of the ventilation damper 116 so that the air discharged from the evaporative cooler 113 may flow (SA) to the indoor space. The installation of the fan described above is only an example, and the scope of the claims is not limited thereto.

Meanwhile, the air supplied from the outdoor unit 100 to the indoor space through an SA damper or the air supplied from the indoor unit 200 by connection to the indoor unit 200 and used for circulation in the indoor space may return (RA) to the outdoor unit 100 again. In some exemplary embodiments in the present disclosure, the air (RA) returning to the outdoor unit 100 from the indoor space may pass through the first flow path 110 and/or may be regenerated and discharged to the outside through the second flow path 120, together with the outside air (OA).

According to another exemplary embodiment in the present disclosure, the first flow path 110 may have one side communicating with the outside and the other side communicating with the indoor space to supply the introduced outside air into the indoor space, and the second flow path 120 may have one side communicating with the outside and the other side communicating with the outside to discharge the introduced outside air to the outside. The first flow path 110 and the second flow path 120 may be divided by a partition PT. This is only an example, and the scope of the claims is not limited thereto.

Meanwhile, the third flow path 110*a* may be further formed in the wet channel of the evaporative cooler 113, and the bleed fan 115*a* may be provided on the third flow path 110*a* to discharge the air branched from the first flow path 110 and introduced into the evaporative cooler 113 to the outside.

The dehumidification rotor 130, the dehumidification fan 112, the evaporative cooler 113, the filter 117, and the ventilation damper 116 may be provided on the first flow path 110, and the heating unit 121, the dehumidification rotor 130, and the regeneration fan 122 may be provided in order on the second flow path 120. The third flow path 110*a* and the fourth flow path 110*b* may each be branched from the first flow path 110 passing through the evaporative cooler 113. The evaporative cooler 113, the bleed fan 115*a*, and the bleed EA damper may be provided in order on the third flow path 110*a*, and the evaporative condenser 114, the condensing fan 115*b*, and the bleed EA damper may be provided in order on the fourth flow path 110*b*. Here, the branch point of the third flow path 110*a* may be positioned on the upstream side of the branch point of the fourth flow path 110*b*, or vice versa. The bleed EA dampers of the third flow path 110*a* and the fourth flow path 110*b* may be the same as or different from each other. It is a matter of course that the positions of the respective components described above may be changed by those skilled in the art as needed.

The dehumidification rotor 130 may have the first region 131 provided on the first flow path 110 and the second region 132 provided on the second flow path 120. The first region 131 and the second region 132 may alternately rotate, and moisture in the air adsorbed in the first region 131 may be removed in the second region 132.

That is, the dehumidification rotor 130 according to an exemplary embodiment in the present disclosure may perform dehumidification in the first region 131 and may be regenerated in the second region 132.

An adsorbent for adsorbing moisture in the air may be provided in such a dehumidification rotor 130, and the dehumidification rotor 130 may rotate around a shaft provided at the center by a driving unit. A structure of the dehumidification rotor 130 described above is widely known in the corresponding field, and thus a detailed description thereof will be omitted to simplify the description of the present disclosure.

Meanwhile, the evaporative cooler 113 may be provided on the first flow path 110 and cool the air passing through the dehumidification rotor 130. The dry channel and the wet channel are provided in such an evaporative cooler 113, and the first water injection module 150 may be further provided in the wet channel to supply moisture to the air flowing in the wet channel. When water is sprayed to the air flowing in the wet channel, the sprayed water is evaporated, such that a plate surrounding the wet channel is cooled, thereby cooling the air flowing in the dry channel. A structure of the evaporative cooler 113 described above is widely known in the corresponding field, and thus a detailed description thereof will be omitted to simplify the description of the present disclosure.

Further, the second water injection module 151 may supply moisture to the air passing through the evaporative condenser 114 by spraying water. The evaporative condenser 114 may pass the cooled air from the evaporative cooler 113 to lower a temperature in the condenser at the time of condensing the refrigerant. For example, as the water is sprayed to the cooled and dehumidified air passing through the evaporative condenser 114, the temperature in the condenser is lowered from 50° C. to 30° C., such that the temperature is prevented from being excessively raised, thereby reducing the power consumption and improving the energy efficiency. The first water injection module 150 and the second water injection 151 module described above may each include a water injection pump supplying water and a spraying nozzle for spraying the water supplied by the water injection pump, and the indoor temperature may be controlled by operation of the water injection pump. As another method, a pressure of direct water from waterworks may be used instead of the water injection pump, and in this case, the water injection pump is not needed, and spraying of water may be controlled by opening and closing a direct water valve.

As described above, the evaporative cooler 113 and the evaporative condenser 114 may be provided, and the evaporative cooler 113 and the evaporative condenser 114 may include the first water injection module 150 and the second water injection module 151, respectively, the first water injection module 150 and the second water injection module 151 spraying water to the evaporative cooler 113 and the evaporative condenser 114, respectively, to use latent heat, thereby improving the cooling efficiency and overall energy efficiency. Specifically, the coefficient of performance (COP) of an air conditioner according to the related art is only 3.1 to 3.7, but the COP according to an exemplary embodiment in the present disclosure is 5.5, which means that the cooling efficiency is significantly improved. The condensing temperature of the evaporative condenser 114 is lowered, and the latent heat is used, thereby reducing power consumption. As a result, the energy efficiency is significantly improved.

Further, the heating unit 121 may be provided on the second flow path 120, heat the introduced outside air using hot water, and supply the heated air to the dehumidification rotor 130 to evaporate moisture contained in the second region 132 of the dehumidification rotor 130, thereby increasing the drying rate of the dehumidification rotor 130. For example, the heating unit 121 may be a hot-water coil or the like.

The dehumidification fan 112 may be provided on the first flow path 110 and make the air passing through the first region 131 of the dehumidification rotor 130 flow to the indoor space, and the regeneration fan 122 may be provided on the second flow path 120 and make the air passing through the second region 132 of the dehumidification rotor 130 flow to the outside.

As illustrated in FIG. 1, the system for ventilation, dehumidification, and cooling according to an exemplary embodiment in the present disclosure may further include: the OA ventilation damper 123 controlling introduction of the outside air into the second flow path 120; and the RA ventilation damper 124 controlling discharging of the indoor air to the outside.

Meanwhile, the system for ventilation, dehumidification, and cooling may further activate at least one of a cooling mode, a ventilation-dehumidification mode, a dehumidification-ventilation mode, a dehumidification mode, an air-cleaning-ventilation mode, or an air-cleaning mode, in addition to the ventilation-dehumidification-cooling mode.

When the system for ventilation, dehumidification, and cooling according to an exemplary embodiment in the present disclosure activates the ventilation-dehumidification-cooling mode as illustrated in FIG. 1, in the ventilation-dehumidification-cooling mode, the controller 153 may operate the dehumidification rotor 130, the dehumidification fan 112, the evaporative cooler 113, and the evaporative condenser 114, open the ventilation damper 116 to supply the low-temperature dehumidified air into the indoor space through the first flow path 110, continuously operate the heating unit 121 and the regeneration fan 122, open the OA ventilation damper 123 and the RA ventilation damper 124, and operate the bleed fan 115*a* and the condensing fan 115*b* to discharge (EA) the air discharged from the wet channel of the evaporative cooler 113 and the evaporative condenser 114 to the outside through the third flow path 110*a* and the fourth flow path 110*b*.

The air flowing (OA) from the outside to the indoor space through the first flow path 110 may become low-temperature dehumidified air by passing through the dehumidification rotor 130, the dehumidification fan 112, and the dry channel of the evaporative cooler 113, may be supplied (SA) to the indoor space through the opened ventilation damper 116. Here, fresh air may be supplied by removing impurities or the like using the filter 117 installed in the ventilation damper 116, and the evaporative condenser 114 disposed on the fourth flow path 110*b* may be operated and drive the refrigerant cycle R1 together with the compressor 118 and the indoor unit 200.

According to an exemplary embodiment in the present disclosure, a portion of the air introduced through the first flow path 110 may be branched to the third flow path 110*a* and discharged (EA) to the outside through the wet channel of the evaporative cooler 113, and the other part may be branched to the fourth flow path 110*b* and discharged (EA) to the outside through the evaporative condenser 114. Alternatively, according to another exemplary embodiment in the present disclosure, the air supplied (OA) from the outside may be discharged (EA) to the outside through the wet channel of the evaporative cooler 113, and partial air supplied (OA) from the outside or branched from the first flow path 110 may be discharged (EA) to the outside through the evaporative condenser 114.

Then, the RA ventilation damper 124 may be opened, such that the air that is circulated in the indoor space and needs to be regenerated returns (RA) from the indoor space and is supplied to the second flow path 120. The OA ventilation damper 123 may be opened, such that the air supplied (OA) from the outside is mixed with the air returning (RA) from the indoor space and supplied to the second flow path 120. The air supplied to the second flow path 120 may pass through the heating unit 121 and be supplied in a heated state to the dehumidification rotor 130 to evaporate moisture contained in the second region 132 of the dehumidification rotor 130, thereby increasing the drying rate of the dehumidification rotor 130. As a result, high-humidity and high-temperature air may be discharged (EA) to the outside by the regeneration fan 122.

That is, according to an exemplary embodiment in the present disclosure, the second flow path 120 may be connected to the regeneration flow path of the dehumidification rotor 130 to discharge (EA) the air returning (RA) from the indoor space and the air supplied (OA) from the outside to the outside through the dehumidification rotor 130.

Alternatively, according to another exemplary embodiment in the present disclosure, the second flow path 120 may be connected to the wet channel of the evaporative cooler 113 to discharge (EA) the air returning (RA) from the indoor space and the air supplied (OA) from the outside to the outside through the wet channel of the evaporative cooler 113. According to another exemplary embodiment in the present disclosure, one ends of the second flow path 120 and the third flow path 110*a* may be connected to each other or the second flow path 120 and the third flow path 110*a* may join each other in the middle.

Here, when the outdoor unit 100 is driven, the dehumidified and cooled air may be provided to the indoor space through the SA damper or the indoor unit 200, and simultaneously, a cooling method using the refrigerant of the indoor unit 200 may be performed in parallel.

Figure 2:
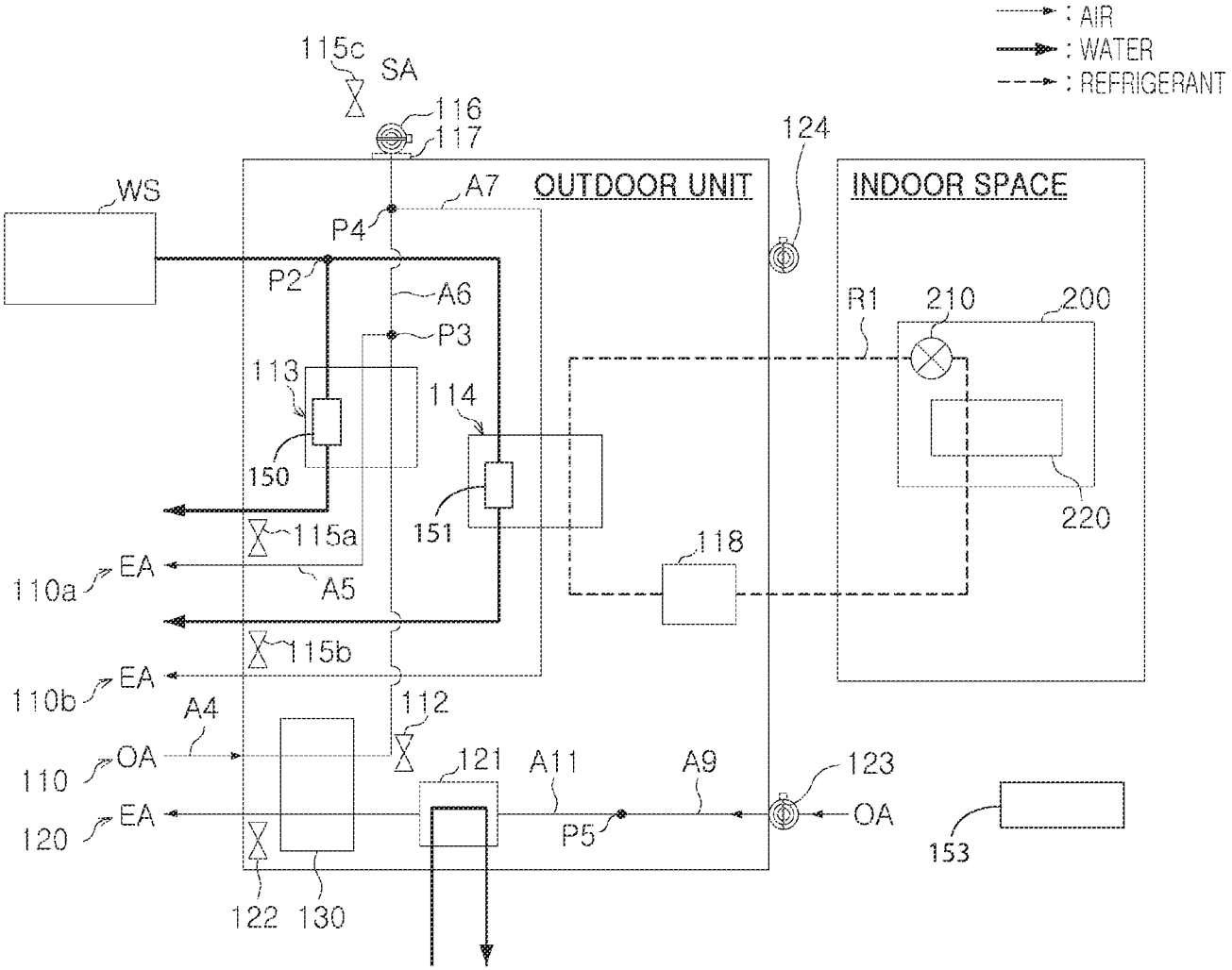
FIG. 2 schematically illustrates an air flow along a flow path in the system for ventilation, dehumidification, and cooling according to an exemplary embodiment in the present disclosure when a cooling mode is activated.

Meanwhile, in a case in which the system for ventilation, dehumidification, and cooling according to an exemplary embodiment in the present disclosure activates the cooling mode as illustrated in FIG. 2, the controller 153 may close the ventilation damper 116 to block the introduction of air into the indoor space, operate the dehumidification rotor 130, the dehumidification fan 112, the evaporative cooler 113, and the evaporative condenser 114, open the OA ventilation damper 123 and close the RA ventilation damper 124 to supply only the outside air to the second flow path 120, and operate the heating unit 121 and the regeneration fan 122. In addition, the controller 153 may operate the bleed fan 115*a* and the condensing fan 115*b* to discharge (EA) the air discharged from the wet channel of the evaporative cooler 113 and the evaporative condenser 114 to the outside through the third flow path 110*a* and the fourth flow path 110*b*.

As illustrated in FIG. 2, when a separate ventilation mode is not activated, the ventilation damper 116 is closed to prevent the air (OA) introduced from the outside from being introduced (SA) into the indoor space and prevent the air (RA) from returning from the indoor space to the outside.

Further, the air (OA) supplied from the outside may be dehumidified by passing through the dehumidification rotor 140 and the dehumidification fan 112 before passing through the evaporative condenser 114, and may be cooled by passing through the dry channel of the evaporative cooler 113, such that low-humidity and low-temperature air is introduced into the evaporative condenser 114, thereby improving evaporation efficiency. In addition, the second water injection module 151 may spray water to significantly increase evaporative latent heat, such that the temperature of the condenser may be efficiently lowered and the cooling efficiency of the evaporative condenser 114 may be significantly improved.

That is, the first water injection module 150 and the second water injection module 151 may spray water to the evaporative cooler 113 and the evaporative condenser 114, respectively, to use latent heat, thereby further improving the energy efficiency. Further, as described above, the COP according to an exemplary embodiment in the present disclosure may be 1.5 to 1.8 times the COP of the air conditioner according to the related art, which means that the cooling efficiency may be significantly improved.

The air (OA) introduced from the outside may pass through the heating unit 121 and the dehumidification rotor 130 on the second flow path 120 to evaporate moisture contained in the second region 132 of the dehumidification rotor 130, thereby increasing the drying rate of the dehumidification rotor 130. As a result, high-humidity air subjected to the heat exchange may be discharged (EA) to the outside by the regeneration fan 122. Here, since there is no air supplied to the indoor space, the air returning (RA) after being circulated in the indoor space is not supplied to the second flow path 120.

In addition, the bleed fan 115*a* and the condensing fan 115*b* may be continuously driven to discharge (EA) the air used for heat exchange in the evaporative cooler 113 to the outside through the third flow path 110*a* and discharge (EA) the air used for heat exchange in the evaporative condenser 114 to the outside through the fourth flow path 110*b*.

That is, according to an exemplary embodiment in the present disclosure, a portion of the air introduced through the first flow path 110 may be branched to the third flow path 110*a* and discharged (EA) to the outside through the wet channel of the evaporative cooler 113, and the other part may be branched to the fourth flow path 110*b* and discharged (EA) to the outside through the evaporative condenser 114.

Alternatively, according to another exemplary embodiment in the present disclosure, the air supplied (OA) from the outside may be discharged (EA) to the outside through the wet channel of the evaporative cooler 113, and partial air supplied (OA) from the outside or branched from the first flow path 110 may be discharged (EA) to the outside through the evaporative condenser 114.

Meanwhile, according to an exemplary embodiment in the present disclosure, the second flow path 120 may be connected to the regeneration flow path of the dehumidification rotor 130 to discharge (EA) the air supplied (OA) from the outside to the outside through the dehumidification rotor 130.

Alternatively, according to another exemplary embodiment in the present disclosure, the second flow path 120 may be connected to the wet channel of the evaporative cooler 113 to discharge (EA) the air supplied (OA) from the outside to the outside through the wet channel of the evaporative cooler 113. According to another exemplary embodiment in the present disclosure, the second flow path 120 and the third flow path 110*a* may be connected to each other or may be the same as each other.

Figure 3:
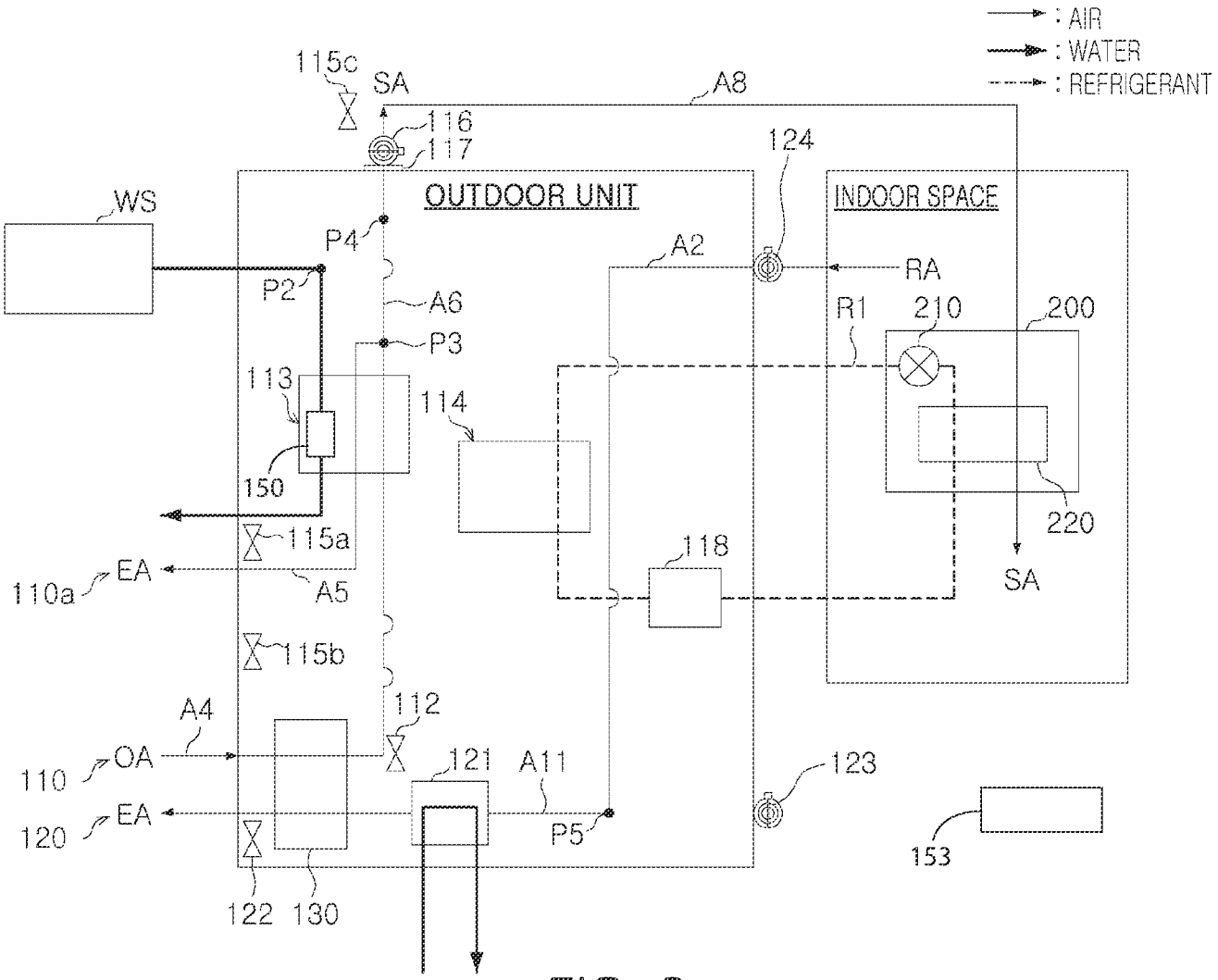
FIG. 3 schematically illustrates an air flow along a flow path in the system for ventilation, dehumidification, and cooling according to an exemplary embodiment in the present disclosure when a ventilation-dehumidification mode is activated.

In another example, the system for ventilation, dehumidification, and cooling according to an exemplary embodiment in the present disclosure may activate the ventilation-dehumidification mode as illustrated in FIG. 3. In a case in which the system for ventilation, dehumidification, and cooling according to an exemplary embodiment in the present disclosure activates the ventilation-dehumidification mode, the controller 153 may open the ventilation damper 116 to supply the air to the indoor space, operate the dehumidification rotor 130, the dehumidification fan 112, and the evaporative cooler 113, stop the evaporative condenser 114, close the OA ventilation damper 123 and open the RA ventilation damper 124 to supply only the air (RA) returning from the indoor space to the second flow path 120, and operate the heating unit 121 and the regeneration fan 122.

Figure 4:
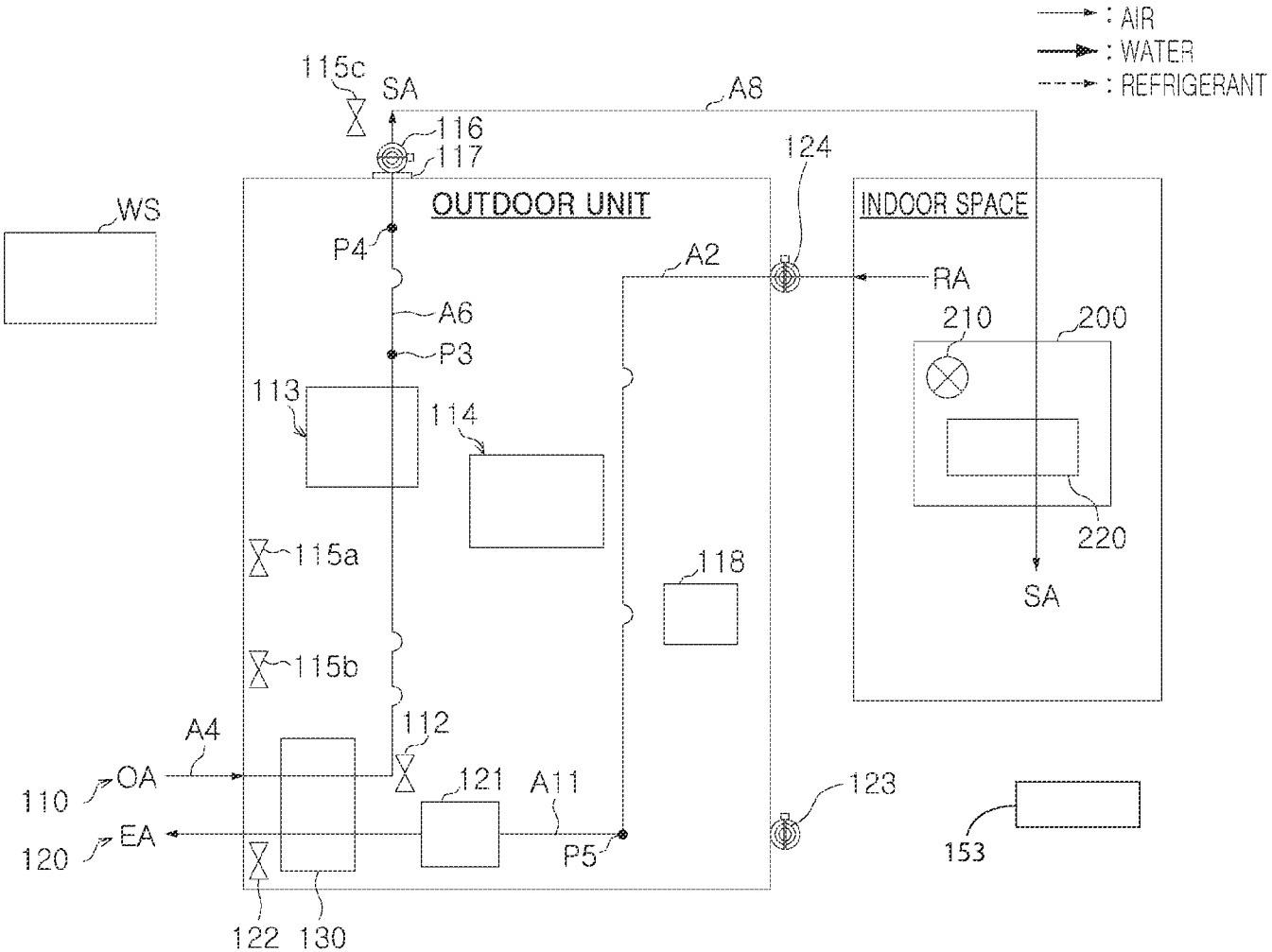
FIG. 4 schematically illustrates an air flow along a flow path in the system for ventilation, dehumidification, and cooling according to an exemplary embodiment in the present disclosure when an air-cleaning-ventilation mode is activated.

In addition, when the dehumidification is insufficient, the indoor unit 200 may be operated together to additionally perform dehumidification to thereby provide dehumidified air through an indoor flow path A10 illustrated in FIG. 4, switching to the ventilation-dehumidification-cooling mode may be made to operate the evaporative condenser 114 together for the operation of the indoor unit 200, and switching to the ventilation-dehumidification mode may be made again once the dehumidification is sufficiently undertaken.

That is, flowing of the air in the ventilation-dehumidification mode according to an exemplary embodiment in the present disclosure is almost the same as that in the ventilation-dehumidification-cooling mode of FIG. 1, but the air (OA) introduced from the outside need not be cooled, and thus the evaporative condenser 114 and the second water injection module 151 may be stopped. Since the evaporative condenser 114 is not driven, the second water injection module 151 and the bleed EA damper installed on the fourth flow path 110*b* are closed, the condensing fan 115*b* is not operated, and the compressor 118 connected to the evaporative condenser 114 is not operated.

However, in summer or rainy season with high outdoor humidity, when the dehumidification is not sufficiently undertaken with the driving of such an outdoor unit 100, the dehumidification may be additionally made by operating the air conditioner in the indoor unit 200. For this, the evaporative condenser 114 and the compressor 118 may be driven to operate the refrigerant cycle R1 of the indoor unit 200.

FIG. 3 illustrates a case in which the refrigerant cycle R1 is operated, and here, the indoor unit 200 is driven to operate the evaporative condenser 114 and the compressor 118 together. In a case in which the indoor unit 200 is not driven together, the refrigerant cycle R1 is not operated.

Further, there is no air (OA) to be introduced from the outdoor through the second flow path 120, a regeneration OA damper installed on the second flow path 120 and through which the air is introduced from the outside is closed, and the regeneration fan 122 may be operated to pass only the air (RA) returning after being circulated in the indoor space through the heating unit 121 and the dehumidification rotor 130, for regeneration.

In a case in which the air (RA) returning after being circulated in the indoor space is discharged to the outside through the third flow path 110*a* as in another exemplary embodiment in the present disclosure, the heating unit 121 and the regeneration fan 122 may also be stopped.

That is, according to an exemplary embodiment in the present disclosure, a portion of the air introduced through the first flow path 110 may be branched to the third flow path 110*a* and discharged (EA) to the outside through the wet channel of the evaporative cooler 113. Alternatively, according to another exemplary embodiment in the present disclosure, the air supplied (OA) from the outside may be discharged (EA) to the outside through the wet channel of the evaporative cooler 113.

Alternatively, according to an exemplary embodiment in the present disclosure, the second flow path 120 may be connected to the regeneration flow path of the dehumidification rotor 130 to discharge (EA) the air returning (RA) from the indoor space to the outside through the dehumidification rotor 130. Alternatively, according to another exemplary embodiment in the present disclosure, the second flow path 120 may be connected to the wet channel of the evaporative cooler 113 to discharge (EA) the air returning (RA) from the indoor space to the outside through the wet channel of the evaporative cooler 113. According to another exemplary embodiment in the present disclosure, one ends of the second flow path 120 and the third flow path 110*a* may be connected to each other or the second flow path 120 and the third flow path 110*a* may join each other in the middle. In another example, the system for ventilation, dehumidification, and cooling according to an exemplary embodiment in the present disclosure may further activate the dehumidification-ventilation mode. When the dehumidification-ventilation mode is activated, the controller 153 may additionally open the OA ventilation damper 123 and control other components in the same manner as in the ventilation-dehumidification mode. In the ventilation-dehumidification the mode and dehumidification-ventilation mode, cooling is not performed, but weak cooling may be incidentally undertaken by the evaporative cooler that is being operated. Therefore, the ventilation-dehumidification mode and the dehumidification-ventilation mode may be included in a weak cooling mode.

That is, in the dehumidification-ventilation mode according to an exemplary embodiment in the present disclosure, the second flow path 120 may be connected to the regeneration flow path of the dehumidification rotor 130 to discharge (EA) the air returning (RA) from the indoor space and the air supplied (OA) from the outside to the outside through the dehumidification rotor 130. Alternatively, according to another exemplary embodiment in the present disclosure, the second flow path 120 may be connected to the wet channel of the evaporative cooler 113 to discharge (EA) the air returning (RA) from the indoor space and the air supplied (OA) from the outside to the outside through the wet channel of the evaporative cooler 113. According to another exemplary embodiment in the present disclosure, one ends of the second flow path 120 and the third flow path 110*a* may be connected to each other or the second flow path 120 and the third flow path 110*a* may join each other in the middle.

In another example, the system for ventilation, dehumidification, and cooling according to an exemplary embodiment in the present disclosure may activate the air-cleaning-ventilation mode as illustrated in FIG. 4. In a case in which the system for ventilation, dehumidification, and cooling according to an exemplary embodiment in the present disclosure activates the air-cleaning-ventilation mode, the controller 153 may operate the dehumidification rotor 130 and the dehumidification fan 112, stop the evaporative cooler 113 and the evaporative condenser 114, open the ventilation damper 116, close the OA ventilation damper 123 and open the RA ventilation damper 124 to supply only the air returning from the indoor space to the second flow path 120, operate the regeneration fan 122, and stop the heating unit 121. That is, only the air (RA) returning after being circulated in the indoor space may be supplied to the second flow path 120 to be regenerated and then discharged (EA) to the outside.

In the air-cleaning-ventilation mode according to an exemplary embodiment in the present disclosure, as illustrated in FIG. 4, the air (OA) supplied from the outside may pass through the dehumidification rotor 130 and the dehumidification fan 112, pass through the stopped evaporative cooler 113, and be supplied (SA) to the indoor space as it is through the opened ventilation damper 116 and the filter 117. Here, the components cooling the air such as the evaporative cooler 113 and the evaporative condenser 114, or the component heating the air such as the heating unit 121 are not operated, and only total heat exchange may be simply made. Therefore, the air does not separately absorb or radiate heat until being supplied (SA) to the indoor space after passing through the dehumidification rotor 130. Here, the first water injection module 150 and the second water injection module 151 in the evaporative condenser 114 and the evaporative cooler 113 are stopped, such that separate latent heat exchange is not made.

Further, since the evaporative cooler 113 and the evaporative condenser 114 are not driven, the condensing fan 115*b* and the bleed fan 115*a* are not driven, and the bleed EA damper installed on the fourth flow path 110*b*, the bleed EA damper installed on the third flow path 110*a*, and the regeneration OA damper installed on the second flow path 120 are also closed, such that the air does not flow.

Then, the air (RA) returning after being circulated in the indoor space may pass through the dehumidification rotor 130, evaporate moisture contained in the second region 132 of the dehumidification rotor 130, and be discharged (EA) to the outside by the regeneration fan 122.

In a case in which the air (RA) returning after being circulated in the indoor space is discharged to the outside through the third flow path 110*a* as in another exemplary embodiment in the present disclosure, the regeneration fan 122 may also be stopped.

That is, according to an exemplary embodiment in the present disclosure, the second flow path 120 may be connected to the regeneration flow path of the dehumidification rotor 130 to discharge (EA) the air returning (RA) from the indoor space to the outside through the dehumidification rotor 130. Alternatively, according to another exemplary embodiment in the present disclosure, the second flow path 120 may be connected to the wet channel of the evaporative cooler 113 to discharge (EA) the air returning (RA) from the indoor space to the outside through the wet channel of the evaporative cooler 113. According to another exemplary embodiment in the present disclosure, one ends of the second flow path 120 and the third flow path 110*a* may be connected to each other or the second flow path 120 and the third flow path 110*a* may join each other in the middle.

However, in this case, the evaporative cooler 113 is stopped. Therefore, the air may simply pass through the wet channel of the evaporative cooler 113 even in a case according to another exemplary embodiment in the present disclosure.

Figure 5:
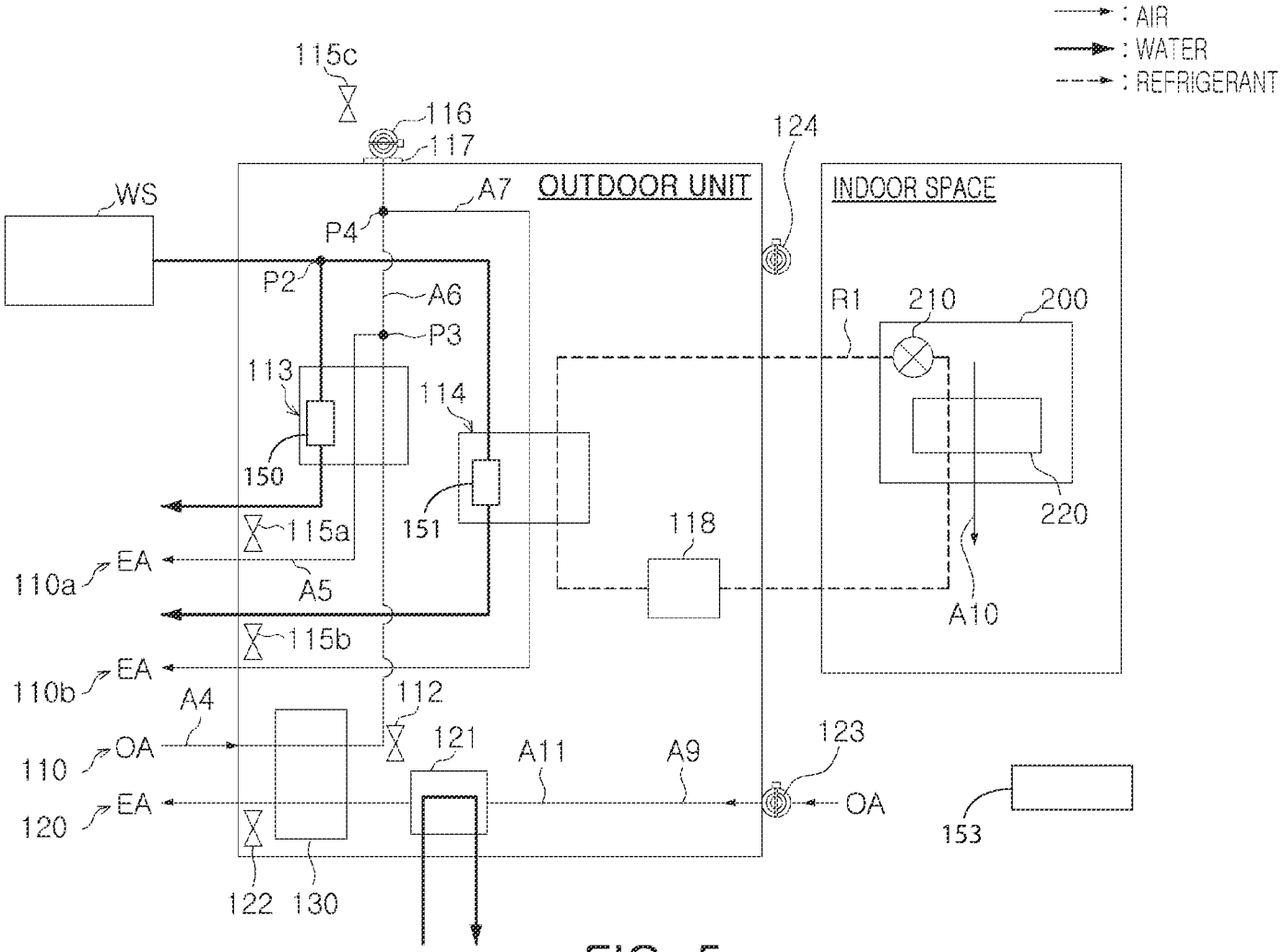
FIG. 5 schematically illustrates an air flow in the system for ventilation, dehumidification, and cooling according to an exemplary embodiment in the present disclosure when a dehumidification mode is activated.

In another example, the system for ventilation, dehumidification, and cooling according to an exemplary embodiment in the present disclosure may activate the dehumidification mode as illustrated in FIG. 5. In a case in which the system for ventilation, dehumidification, and cooling according to an exemplary embodiment in the present disclosure activates the dehumidification mode, the controller 153 may close the ventilation damper 116 to block the introduction of air into the indoor space, operate the dehumidification rotor 130, the dehumidification fan 112, and the evaporative cooler 113, open the OA ventilation damper 123 and close the RA ventilation damper 124 to supply only the outside air to the second flow path 120, and operate the heating unit 121 and the regeneration fan 122.

In the dehumidification mode, the controller 153 may also operate the bleed fan 115*a* and the condensing fan 115*b* to discharge (EA) the air discharged from the wet channel of the evaporative cooler 113 and the evaporative condenser 114 to the outside through the third flow path 110*a* and the fourth flow path 110*b*. Here, the air introduced into the first flow path 110 only passes through the evaporative condenser 114 because the ventilation damper 116 is closed, and the evaporative condenser 114 is not driven.

However, in a case in which additional dehumidification is made by operating the indoor unit 200 together, the evaporative condenser 114 may be additionally operated, and the refrigerant cycle including the evaporative condenser 114 may be operated.

That is, in the dehumidification mode, the ventilation damper 116 is stopped, and the dehumidification may be performed by driving the indoor unit 200 together without ventilation.

Specifically, in the dehumidification mode according to an exemplary embodiment in the present disclosure, as illustrated in FIG. 5, the air (OA) supplied from the outside may pass through the dehumidification rotor 130, the dehumidification fan 112, and the evaporative cooler 113 that is being operated, and the air is not supplied (SA) to the indoor space by the closed ventilation damper 116. Alternatively, according to an exemplary embodiment in the present disclosure, the entire air passing through the evaporative cooler 113 may be discharged (EA) to the outside through the fourth flow path 110*b*.

Further, as illustrated in FIG. 5, since the ventilation is not performed, there is no air (RA) returning from the indoor space, and the air may be introduced (OA) from the outside into the second flow path 120 and discharged (EA) through the heating unit 121, the dehumidification rotor 130, and the regeneration fan 122.

Further, the evaporative condenser 114 is also driven in the dehumidification mode, but this is to drive the indoor unit 200 and perform dehumidification using the indoor unit 200.

Meanwhile, even in a case in which the dehumidification mode is not activated or there is no dehumidification mode, the controller 153 may operate the indoor unit 200 together to additionally perform dehumidification when the dehumidification is not sufficiently undertaken, and at this time, the evaporative condenser 114 may be additionally operated for the operation of the indoor unit regardless of the mode. As the evaporative condenser 114 is used, the cooling efficiency and the energy efficiency may be significantly improved.

That is, according to an exemplary embodiment in the present disclosure, a portion of the air introduced through the first flow path 110 may be branched to the third flow path 110*a* and discharged (EA) to the outside through the wet channel of the evaporative cooler 113, and the other part may be branched to the fourth flow path 110*b* and discharged (EA) to the outside through the evaporative condenser 114. Alternatively, according to another exemplary embodiment in the present disclosure, the air supplied (OA) from the outside may be discharged (EA) to the outside through the wet channel of the evaporative cooler 113, and partial air supplied (OA) from the outside or branched from the first flow path 110 may be discharged (EA) to the outside through the evaporative condenser 114.

Further, according to an exemplary embodiment in the present disclosure, the second flow path 120 may be connected to the regeneration flow path of the dehumidification rotor 130 to discharge (EA) the air supplied (OA) from the outside to the outside through the dehumidification rotor 130. Alternatively, according to another exemplary embodiment in the present disclosure, the second flow path 120 may be connected to the wet channel of the evaporative cooler 113 to discharge (EA) the air supplied (OA) from the outside to the outside through the wet channel of the evaporative cooler 113. According to another exemplary embodiment in the present disclosure, one ends of the second flow path 120 and the third flow path 110*a* may be connected to each other, or the second flow path 120 and the third flow path 110*a* may join each other in the middle or may be the same as each other.

Figure 6:
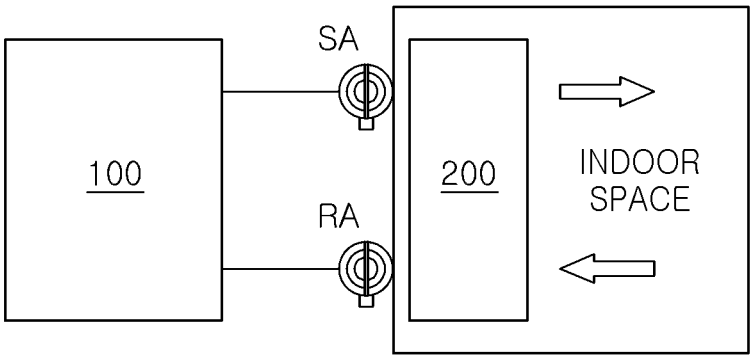
FIG. 6 schematically illustrates an air flow along a flow path in the system for ventilation, dehumidification, and cooling according to an exemplary embodiment in the present disclosure when an air-cleaning mode is activated.

In another example, the system for ventilation, dehumidification, and cooling according to an exemplary embodiment in the present disclosure may activate the air-cleaning mode as illustrated in FIG. 6. In a case in which the air-cleaning mode is activated, the controller 153 may stop the outdoor unit 100, and operate the indoor unit 200 to circulate the air in the indoor space through an internal filter of the indoor unit.

As illustrated in FIG. 6, since the outdoor unit 100 is completely turned off, the air is not introduced (SA) from the outside or the air does not return (RA) from the indoor space. Only the indoor unit 200 may be operated, and the indoor air may be filtered by the filter of the indoor unit, and circulated in the indoor space.

However, when the indoor unit 200 performs cooling, the outdoor unit 100 may operate the evaporative condenser 114 and the compressor 118 connected to the indoor unit 200 through the refrigerant pipe to drive the indoor unit 200.

According to another exemplary embodiment in the present disclosure, in a case in which the second flow path 120 is formed so that the air returning (RA) from the indoor space is introduced into the evaporative cooler 113, air cleaning for all spaces may be performed only using the filter of the outdoor unit.

In a case of using the filter of the indoor unit, each filter needs to be connected to the indoor unit of each space to perform air cleaning. However, in a case in which air cleaning is performed for all spaces according to another exemplary embodiment in the present disclosure, air cleaning may be performed for all spaces using one filter of the outdoor unit.

That is, according to the present disclosure, the system for ventilation, dehumidification, and cooling may perform ventilation, dehumidification, cooling, and air cleaning simultaneously, may also activate only one of the plurality of modes, may utilize low-temperature dehumidified air to improve the cooling efficiency and the energy efficiency, and may occupy less space, thereby achieving cost reduction.

According to an exemplary embodiment in the present disclosure, the indoor unit operated in the above-described modes may be an air conditioner, and the controller 153 may operate the outdoor unit and control the air conditioner to perform cooling simultaneously. Specifically, the indoor unit may be a ceiling type air conditioner installed on a ceiling, and the first flow path of the outdoor unit may be connected to the indoor unit so that air supplied from the outdoor unit is supplied to the indoor space through the indoor unit.

According to an exemplary embodiment in the present disclosure, a diffuser connected to the first flow path 110*a* may be attached to the indoor unit, such that the air supplied from the outdoor unit 100 may be directly discharged through the indoor unit 200 without a separate SA damper or a separate ventilation fan 115*c*.

Alternatively, separate diffusers SA and RA may be installed to separately supply the air provided from the outdoor unit 100 and the air provided from the indoor unit 200.

The outside air may be directly cooled and dehumidified by the indoor unit 200 and filtered by the filter 117. Therefore, all the cooling, dehumidification, and ventilation may be performed by one indoor unit 200, and there is no need to install a separate device in the indoor space for each mode. As a result, indoor space saving may be achieved and the user experience may be enhanced. Cooling and dehumidification efficiency and energy efficiency can be improved, which may even achieve cost reduction. Therefore, ventilation, dehumidification, and cooling may be efficiently performed by controlling the operations of the indoor air conditioner 200 installed inside and the outdoor unit 100 while significantly improving the energy efficiency compared to simply installing the air conditioner.

Figure 7:
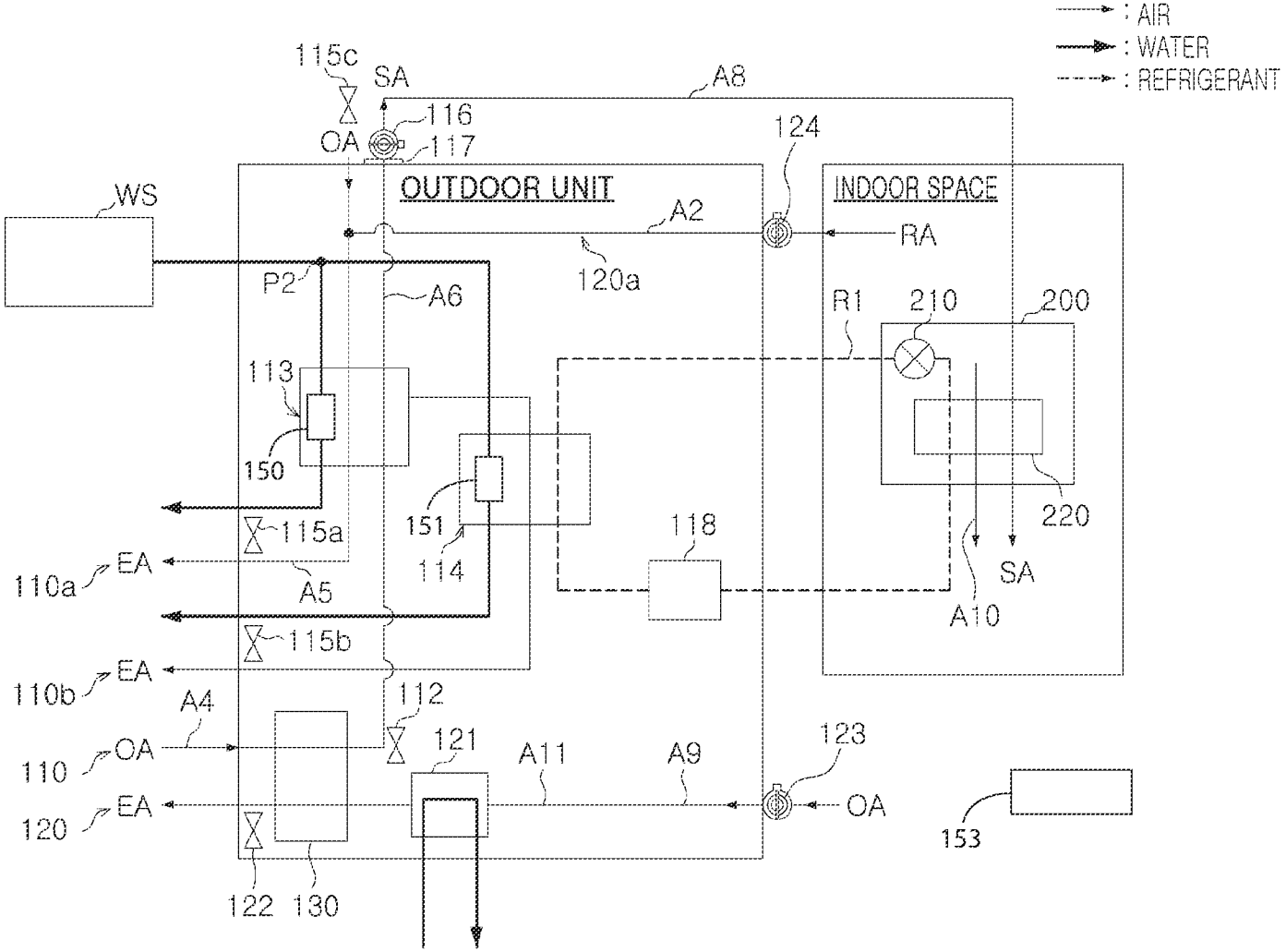
FIG. 7 schematically illustrates an air flow along a flow path in the system for ventilation, dehumidification, and cooling according to another exemplary embodiment in the present disclosure when the ventilation-dehumidification-cooling mode is activated.

FIG. 7 schematically illustrates an air flow in the system for ventilation, dehumidification, and cooling according to another exemplary embodiment in the present disclosure.

In FIG. 1, the third flow path 110*a* and the fourth flow path 110*b* are branched from the first flow path 110, the air passing through the dry channel of the evaporative cooler 113 passes through the wet channel of the evaporative cooler 113 on the third flow path 110*a* and is discharged (EA) to the outside, or passes through the evaporative condenser 114 on the fourth flow path 110*b* and is discharged (EA) to the outside.

On the other hand, in FIG. 7, the third flow path 110*a* and the fourth flow path 110*b* are not branched from the first flow path 110. Specifically, the third flow path 110*a* may be formed so that the air is introduced (OA) from the outside and is discharged (EA) to the outside through the wet channel of the evaporative cooler 113, and the fourth flow path 110*b* may be formed so that the air is discharged (EA) from the dry channel of the evaporative cooler 113 to the outside through the evaporative condenser 114.

Alternatively, unlike the configuration illustrated in FIG. 7, the fourth flow path 110*b* may be formed so that the air is introduced (OA) from the outside and is discharged (EA) to the outside again through the evaporative condenser 114.

In addition, as illustrated in FIG. 7, the RA ventilation damper 124 may be connected to the wet channel of the evaporative cooler 113. In this case, air returning (RA) from the indoor space may pass through the wet channel of the evaporative cooler 113 and be discharged through the third flow path 110*a*, or the air returning (RA) from the indoor space may be introduced into the wet channel of the evaporative cooler 113 together with the air introduced (OA) from the outside and be discharged through the third flow path 110*a*.

Therefore, according to an exemplary embodiment in the present disclosure, the system for ventilation, dehumidification, and cooling may further include the RA ventilation damper 124 connected to a flow path through which the air (RA) returning from the indoor space is discharged (EA) to the outside, the RA ventilation damper 124 may be connected to the wet channel of the evaporative cooler 113, and the flow path through which the air (RA) returning from the indoor space is discharged (EA) to the outside may be the second flow path 120 as illustrated in FIG. 1, a separate fifth flow path 120*a* as illustrated in FIG. 7, or an additional flow path connected to the second flow path 120 illustrated in FIG. 1, joining the third flow path 110*a*, and connected to the wet channel of the evaporative cooler 113.

Figure 8:
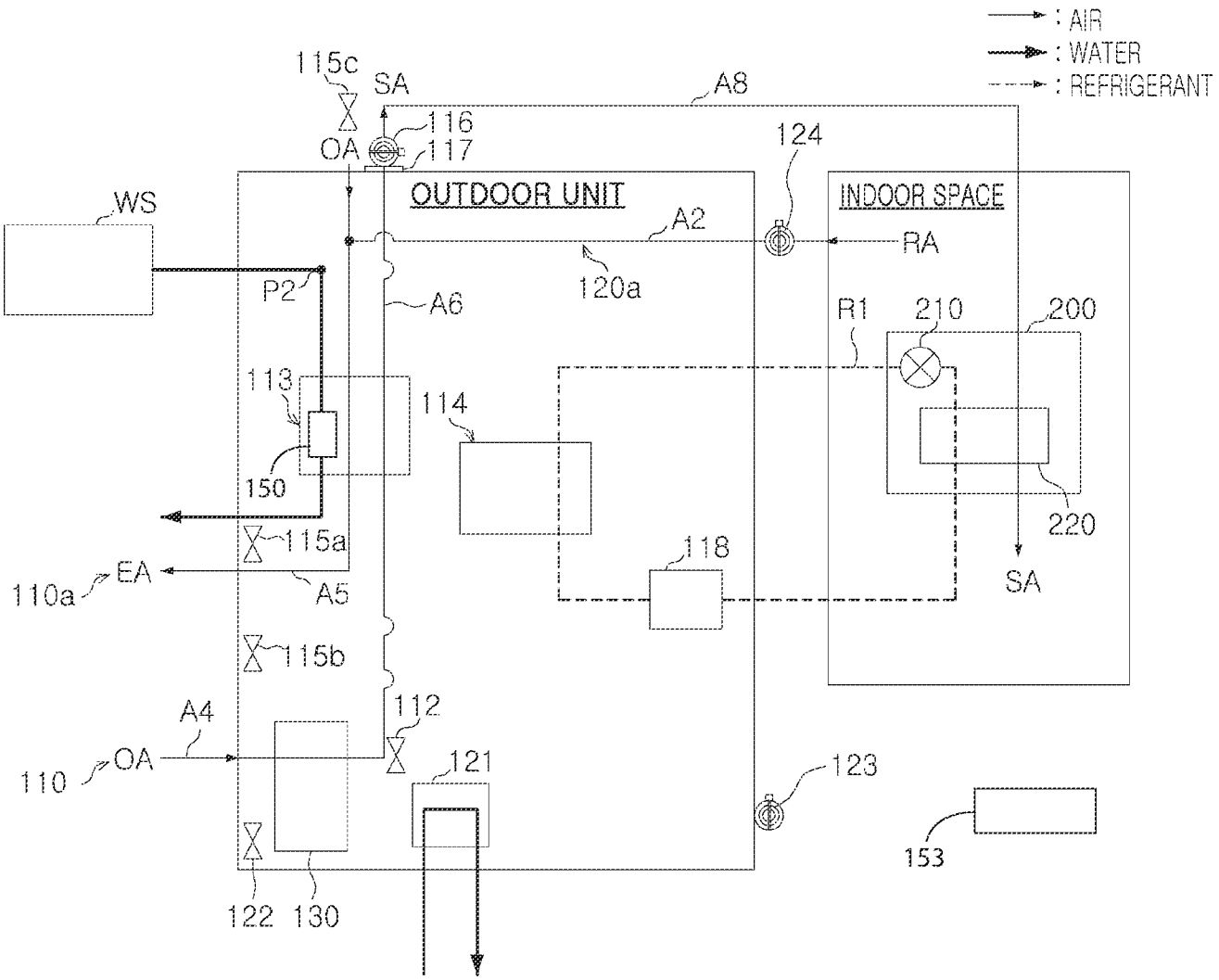
FIG. 8 schematically illustrates an air flow along a flow path in the system for ventilation, dehumidification, and cooling according to another exemplary embodiment in the present disclosure when the ventilation-dehumidification mode is activated.
Figure 9:
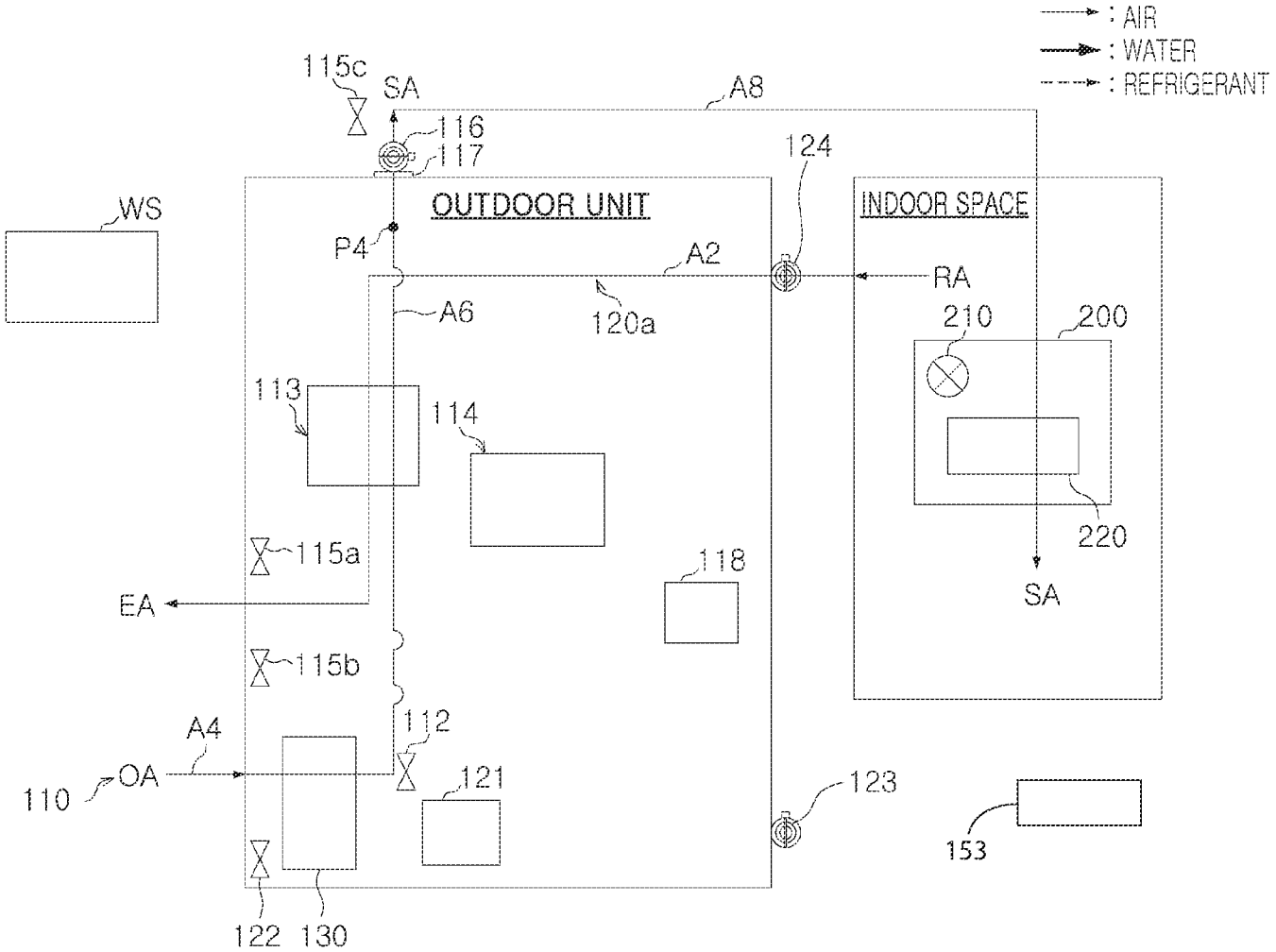
FIG. 9 schematically illustrates an air flow along a flow path in the system for ventilation, dehumidification, and cooling according to another exemplary embodiment in the present disclosure when the air-cleaning-ventilation mode is activated.

FIG. 8 schematically illustrates an air flow along the flow path in the system for ventilation, dehumidification, and cooling according to another exemplary embodiment in the present disclosure when the ventilation-dehumidification mode is activated, and FIG. 9 schematically illustrates an air flow when the air-cleaning-ventilation mode is activated.

Particularly, FIG. 8 illustrates a case in which the refrigerant cycle R1 is operated, and here, the indoor unit 200 is driven to operate the evaporative condenser 114 and the compressor 118 together. In a case in which the indoor unit 200 is not driven together, the refrigerant cycle R1 is not operated.

The above-described other modes may also be applied to another exemplary embodiment in the present disclosure, and an overlapping description will be omitted.

As described above, according to an exemplary embodiment in the present disclosure, a plurality of modes may be set in a device for dehumidification and ventilation according to an outdoor temperature, an indoor temperature, outdoor humidity, and indoor humidity, and the device for dehumidification and ventilation may be controlled according to any one of the plurality of set modes, thereby keeping the indoor air comfortable according to the change of the season.

As set forth above, according to the exemplary embodiment in the present disclosure, the air conditioner that is capable of reducing power consumption using the evaporative cooler and the evaporative condenser to control an increase in temperature, capable of improving the energy efficiency using the first and second water injection modules to utilize latent heat of water, and capable of performing cooling, dehumidification, ventilation, and air cleaning simultaneously may keep the indoor air comfortable.

Further, dehumidified and cooled air may be directly discharged from the outdoor unit through the indoor unit, such that cooling, dehumidification, ventilation, and air cleaning may be performed simultaneously, such that user experience May be enhanced.

While exemplary embodiments have been shown and described above, it will be apparent to those skilled in the art that modifications and variations could be made without departing from the scope of the present invention as defined by the appended claims.

What is claimed is:

1. A system for ventilation, dehumidification, and cooling, wherein the system comprising:

an outdoor unit dehumidifying and cooling introduced outside air; and an indoor unit connected to the outdoor unit to perform ventilation, wherein the outdoor unit includes:

a first flow path connecting an outside and an indoor space and on which an evaporative cooler is disposed;

a second flow path connecting the outside or the indoor space and a dehumidification rotor and on which a heating unit is disposed;

a third flow path connecting the evaporative cooler and the outside;

a fourth flow path connecting an evaporative condenser and the outside;

the dehumidification rotor rotating in a first region provided on the first flow path and a second region provided on the second flow path, dehumidifying the first region, and regenerated in the second region;

the evaporative cooler including a dry channel provided on the first flow path and a wet channel provided on the third flow path and to which water is sprayed by a first water injection module, and cooling air passing through the dehumidification rotor;

the evaporative condenser through which the air passing through the dry channel of the evaporative cooler passes on the fourth flow path and into which the water is sprayed by a second water injection module;

a ventilation damper provided on the first flow path and controlling introduction of the air passing through the evaporative cooler into the indoor space; and the heating unit provided on the second flow path on an upstream side of the second region and heating the air moving to the second region;

wherein at least one of the dehumidification rotor, the evaporative cooler, the evaporative condenser, the ventilation damper, or the heating unit is controlled to be operated or stopped.

2. The system of claim 1, wherein the third flow path is branched from the first flow path and connected to the outside through the evaporative cooler, and the fourth flow path is branched from the first flow path and connected to the outside through the evaporative condenser.

3. The system of claim 1, wherein one ends of the third flow path and the fourth flow path are connected to each other and connected to the outside so that the air flowing on the third flow path and the air flowing on the fourth flow path join and are discharged together to the outside.

4. The system of claim 1, wherein the evaporative condenser is connected to an evaporator in the indoor unit through a compressor.

5. The system of claim 1, further comprising:

an OA ventilation damper controlling introduction of the outside air into the second flow path; and an RA ventilation damper controlling discharging of indoor air to the outside.

6. The system of claim 5, further comprising:

a bleed fan provided on the third flow path and discharging the air passing through the wet channel to the outside;

a condensing fan discharging the air passing through the evaporative condenser to the outside;

a dehumidification fan provided on the first flow path and making the air passing through the first region of the dehumidification rotor flow to the indoor space; and a regeneration fan provided on the second flow path and discharging the air passing through the second region to the outside.

7. The system of claim 6, wherein when the ventilation-dehumidification-cooling mode is activated, the dehumidification rotor, the dehumidification fan, the evaporative cooler, and the evaporative condenser are operated, and the ventilation damper is opened to supply low-temperature dehumidified air into the indoor space through the first flow path, continuously the heating unit and the regeneration fan are operated, and the OA ventilation damper and the RA ventilation damper are opened, and the bleed fan and the condensing fan are operated to discharge the air discharged from the wet channel of the evaporative cooler and the evaporative condenser to the outside through the third flow path and the fourth flow path.

8. The system of claim 6, wherein the system is operable in a cooling mode, and when the cooling mode is activated, the ventilation damper is closed to block the introduction of air into the indoor space, the dehumidification rotor, the dehumidification fan, the evaporative cooler, and the evaporative condenser are operated, the OA ventilation damper is opened and the RA ventilation damper is closed to supply only the outside air to the second flow path, the heating unit and the regeneration fan are operated, and the bleed fan and the condensing fan are operated to discharge the air discharged from the wet channel of the evaporative cooler and the evaporative condenser to the outside through the third flow path and the fourth flow path.

9. The system of claim 6, wherein the system is operable in a ventilation-dehumidification mode, and when the ventilation-dehumidification mode is activated, the ventilation damper is opened to supply the air to the indoor space, the dehumidification rotor, the dehumidification fan, and the evaporative cooler are operated, the evaporative condenser is stopped, the OA ventilation damper is closed and the RA ventilation damper is opened to supply only air returning from the indoor space to the second flow path, and the heating unit and the regeneration fan are operated.

10. The system of claim 9, wherein the system is operable in a dehumidification-ventilation mode, and when the dehumidification-ventilation mode is activated, only the OA ventilation damper is additionally opened and other components are controlled in the same manner as in the ventilation-dehumidification mode.

11. The system of claim 10, wherein in the ventilation-dehumidification mode and the dehumidification-ventilation mode, weak cooling is incidentally undertaken by the evaporative cooler that is being operated.

12. The system of claim 6, wherein the system is operable in an air-cleaning-ventilation mode, and when the air-cleaning-ventilation mode is activated, the dehumidification rotor and the dehumidification fan are operated and the evaporative cooler and the evaporative condenser are stopped, the ventilation damper is opened to supply the air to the indoor space, the OA ventilation damper is closed and the RA ventilation damper is opened to supply only air returning from the indoor space to the second flow path, the regeneration fan is operated, and the heating unit is stopped.

13. The system of claim 6, wherein the system is operable in an air-cleaning mode, and when the air-cleaning mode is activated, the outdoor unit is stopped and the indoor unit is operated to supply the air to the indoor space through an internal filter of the indoor unit.

14. The system of claim 6, wherein the system is operable in a dehumidification mode, and when the dehumidification mode is activated, the ventilation damper is closed to block the introduction of air into the indoor space, the dehumidification rotor, the dehumidification fan, and the evaporative cooler are operated, the OA ventilation damper is opened and the RA ventilation damper is closed to supply only the outside air to the second flow path, the heating unit and the regeneration fan are operated, and the bleed fan and the condensing fan are operated to discharge the air discharged from the wet channel of the evaporative cooler and the evaporative condenser to the outside through the third flow path and the fourth flow path.

15. The system of claim 6, wherein for additional dehumidification, the evaporative condenser is additionally operated, and a refrigerant cycle including the evaporative condenser is driven to operate the indoor unit together.

16. The system of claim 1, wherein the indoor unit is an air conditioner, and the outdoor unit is operated when the air conditioner performs cooling, simultaneously.

17. The system of claim 1, wherein the indoor unit is a ceiling type air conditioner installed on a ceiling, and the first flow path of the outdoor unit is connected to the indoor unit so that air supplied from the outdoor unit is supplied to the indoor space through the indoor unit.

18. The system of claim 1, further comprising an RA ventilation damper controlling discharging of indoor air to the outside, wherein the RA ventilation damper is connected to the wet channel of the evaporative cooler.

* * * * *